United States Patent [19]

Liu

[11] Patent Number: 4,875,807

[45] Date of Patent: Oct. 24, 1989

[54] METHOD AND MEANS FOR BASEMENT CONSTRUCTION

[76] Inventor: Jen-Jui Liu, No. 253, Chueh-Min Rd., San-Min District, Kaohsiung, Taiwan

[21] Appl. No.: 195,686

[22] Filed: May 17, 1988

[51] Int. Cl.[4] ..... E02D 5/00

[52] U.S. Cl. ..... 405/229; 52/742

[58] Field of Search ..... 405/229, 267; 52/742, 52/169.6

[56] References Cited

U.S. PATENT DOCUMENTS

| | | | |
|---|---|---|---|
| 2,381,014 | 8/1945 | Thornley | 405/229 |
| 3,407,552 | 10/1968 | Cassidy | 405/229 X |
| 3,902,326 | 9/1975 | Langenbach, Jr. | 405/229 |
| 4,453,862 | 6/1984 | Stenne | 405/267 |
| 4,463,529 | 8/1984 | Singer et al. | 405/229 X |
| 4,465,403 | 8/1984 | Schrieber et al. | 405/262 |

*Primary Examiner*—Peter A. Aschenbrenner
*Assistant Examiner*—Thomas A. Rendos
*Attorney, Agent, or Firm*—Cushman, Darby & Cushman

[57] ABSTRACT

A method and means for basement construction includes the steps of: excavating a continuous side wall trench; preparing a plurality of reinforcement structures with projecting steel rods extending on one side; attaching a baffle plate to a lower portion of each reinforcement structure for being placed in the side wall trench with the projecting steel rods being driven into the earth; providing a trough device at each running side of each reinforcement structure in the side wall trench with a buffer material lining the inner wall of each trough device; and positioning an H-member against the open section of each trough device for sealing up the side wall trench thereat; so that, after removing the earth within the side wall area and after completing grouting operations, a continuous side wall for a basement will be effectively accomplished without requiring molding operations. In addition, for constructing a larger basement, a plurality of cast-in-place side pillars and a foundation pile are constructed for building a plurality of cross beams through a molding device so as to constitute a safer and stronger basement therewith.

9 Claims, 6 Drawing Sheets

METHOD AND MEANS FOR BASEMENT CONSTRUCTION

BACKGROUND OF THE INVENTION

This invention relates to a method and means for basement construction, and more particularly to a simple method of construction which would insure a shock proof and leak proof structure and would reduce the required working time and manpower as well.

The earlier conventional method for basement construction is shown in FIG. 1. Before excavation of the construction site can begin, piling work to prevent landslides has to be done first by driving a plurality of I-steels 10 into the ground about 7 meters deep and 40 to 50 centimeters apart for the entire distance around the site. This method of piling before excavation is rather time-consuming; and above all, during the rainy season this method will slow down construction work, and allow landslides to occur easily. After the excavation is complete, hooped reinforcements 11 are placed on the four sides of the site and mold mounting operations around the reinforcements 11 are completed so that cement grouting may begin and a continuous concrete wall around the site may be formed. Finally, after the concrete wall is hardened, all molds have to be removed, which wastes a lot of time and material. In addition, if the basement area is large, many H-beams have to be used to brace the opposing walls, and these H-beams will remain in place until construction of the basement is complete.

A later developed method for basement construction is a continuous wall grouting method which does not require mold mounting operations. As shown in FIG. 2, the four side wall areas 20 of the construction site are dug out first and four pre-cast foundation piles 22 are positioned at the four corners. Then the hooped reinforments 201 are respectively placed in the wall area 20 for direct cement grouting operations to form a continuous wall around the basement site. Finally, earth in the basement site is removed to form a basement space 21. After the floor reinforcement 211 is laid out and cement grouting is done, basement construction is completed. The shortcoming of this known method is that there is no substantial connection made between the reinforcements of the continuous wall and the reinforcements of the basement floor except for the joint of the solidified cement, which is shock proof and leak proof.

SUMMARY OF THE INVENTION

It is accordingly a primary object of this invention to provide a method and means for basement construction that overcomes the foregoing problems associated with the prior art.

This and other objects of the present invention are achieved by providing a method and means for basement construction, which comprises the steps of: (a) excavating a continuous side wall trench; (b) preparing a plurality of reinforcement structures, each having a plurality of projecting steel rods horizontally provided in rows at the upper and lower portions thereof; (c) detachably fixing a plurality of baffle plates, each having a plurality of orifices formed in rows therein, on the lower portion of each reinforcement structure with the projecting steel rods respectively extending out of the orifices of the baffle plates; (d) detachably installing a plurality of pushing jacks on the back side of the baffle plate (the quantity of the pushing jacks is determined on the basis of the baffle plate length); (e) vertically positioning the prepared reinforcement structures, together with the baffle plates and pushing jacks, in the side wall trench and driving the baffle plates with the pushing jacks to push the projecting steel rods of the reinforcement structure into the earth until the baffle plates are abutted upon the earth to be excavated; (f) vertically setting a trough means against each running end of each reinforcement structure with the open section of each trough means facing outward and having a buffer member closely placed against the inner wall of each trough means; (g) positioning an H-member against the open section of each trough means; (h) attaching a hydraulic jack at the dent portion of each H-member for pushing it against the trough means and the reinforcement structures; and (i) detaching and taking out the pushing jacks from the continuous side wall trench and beginning grouting operation to complete a portion of the continuous side wall of the basement without requiring molding operations. By taking out the H-members and repeating the above-described steps from (a) to (i), a complete continuous side wall of the basement can be effectively accomplished. For a larger basement, the method and means according to this invention further comprises the steps of: constructing a plurality of cast-in-place side pillars at a proper place along the outside of the continuous side wall; constructing a foundation pile in a middle area of the basement ground; and building a cross beam through a molding means between every opposing side pillars and across the foundation pile. After the earth within the continuous side wall is removed, the projecting steel rods at the lower portion of the prearranged reinforcement structures will be completely exposed, and after the baffle plates are disconnected and taken away therefrom, the construction work can be conveniently continued by laying out the floor reinforcements with each one of the projecting steel rods being tied or welded to the floor reinforcements for grouting operations. In this way, a safe and strongly consolidated floor for the basement is constructed.

Other advantages and characteristics of the present invention will become apparent from the following detailed description when read in conjunction with the accompanying drawings.

DETAILED DESCRIPTION OF THE PREFERRED EMBODIMENT

Figure 1:
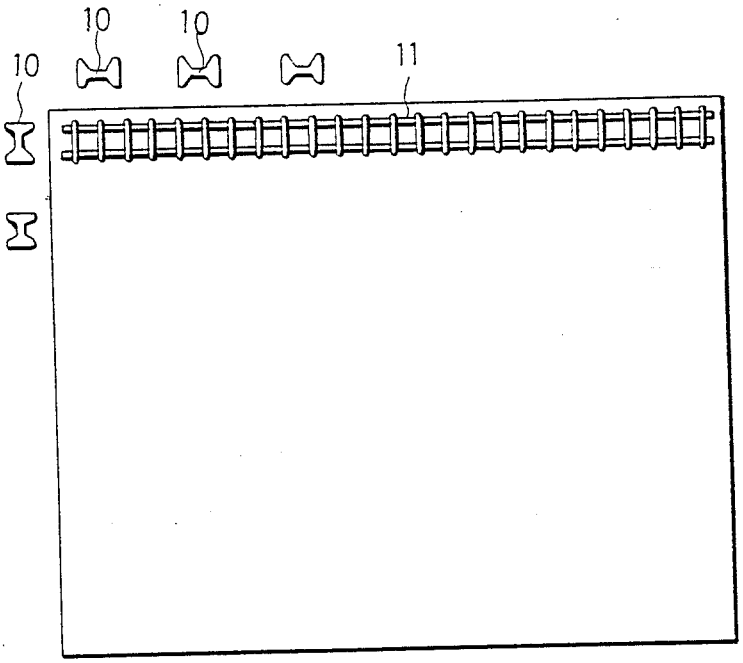
FIG . 1 (PRIOR ART)
FIG. 1 is an illustrative view of a basement construction method of a prior art.
Figure 2:
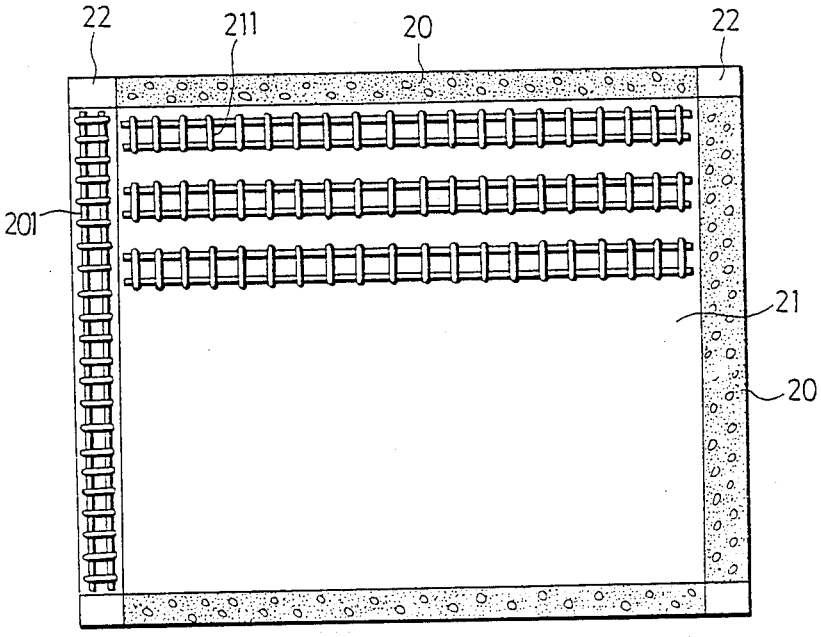
FIG . 2 (PRIOR ART)
FIG. 2 is an illustrative view of a known continuous-wall construction method for a basement.
Figure 3:
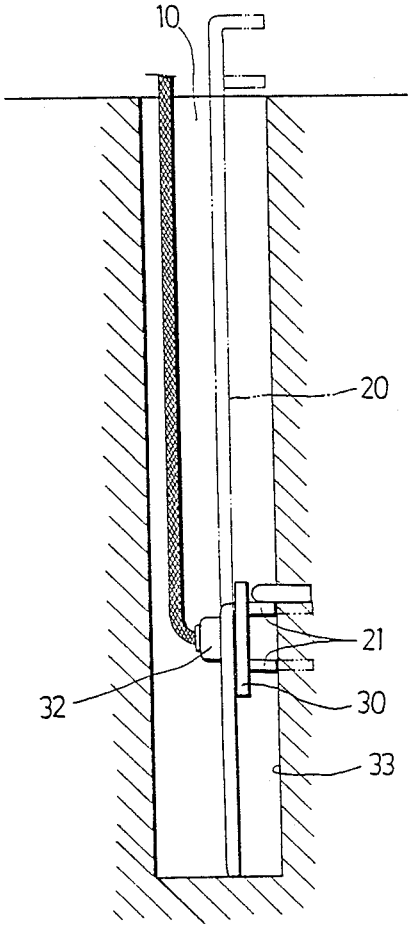
FIG. 3 is an illustrative view of a preferred embodiment of the method and means for constructing a basement according to this invention.
Figure 4:
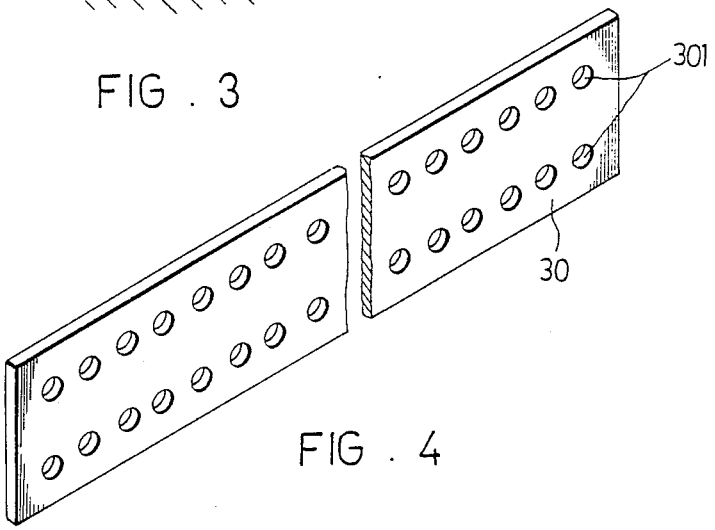
FIG. 4 is a perspective view of a baffle plate designed for constructing a basement according to this invention.

Referring to FIGS. 3 and 4, the preferred embodiment of a method and means for constructing a basement according to this invention comprises the steps of: excavating a continuous side wall trench 10 at a basement site; preparing a plurality of reinforcement structures 20 according to the side wall trench 10, wherein each one of the reinforcement structures 20 includes a multiplicity of projecting steel rods 21 horizontally provided in rows at the upper and lower ends on one side of each reinforcement structure 20; detachably fixing a plurality of baffle plates 30, each having a plurality of orifices 301 formed in rows therein, at the lower end on one side of each reinforcement structure 20 with projecting steel rods 21 respectively extending out of orifices 301 of the baffle plate 30; detachably installing a plurality of pushing jacks 32 on the back side of the baffle plate 30 (the quantity of pushing jacks is determined according to the length of the baffle plate 30 used for each reinforcement structure 20); vertically positioning the prepared reinforcement structures 20, together with the baffle plates 30 and the pushing jacks 32, in the side wall trench 10; and driving the baffle plates 30 against the earth so as to push all the projecting steel rods 21 into the earth until the baffle plates abut upon the earth surface (as shown by the hatched lines in FIG. 3); and detaching and taking out the pushing jacks 32 so that grouting operations can begin and a continuous side wall in the site of a basement will be completed.

Figure 5:
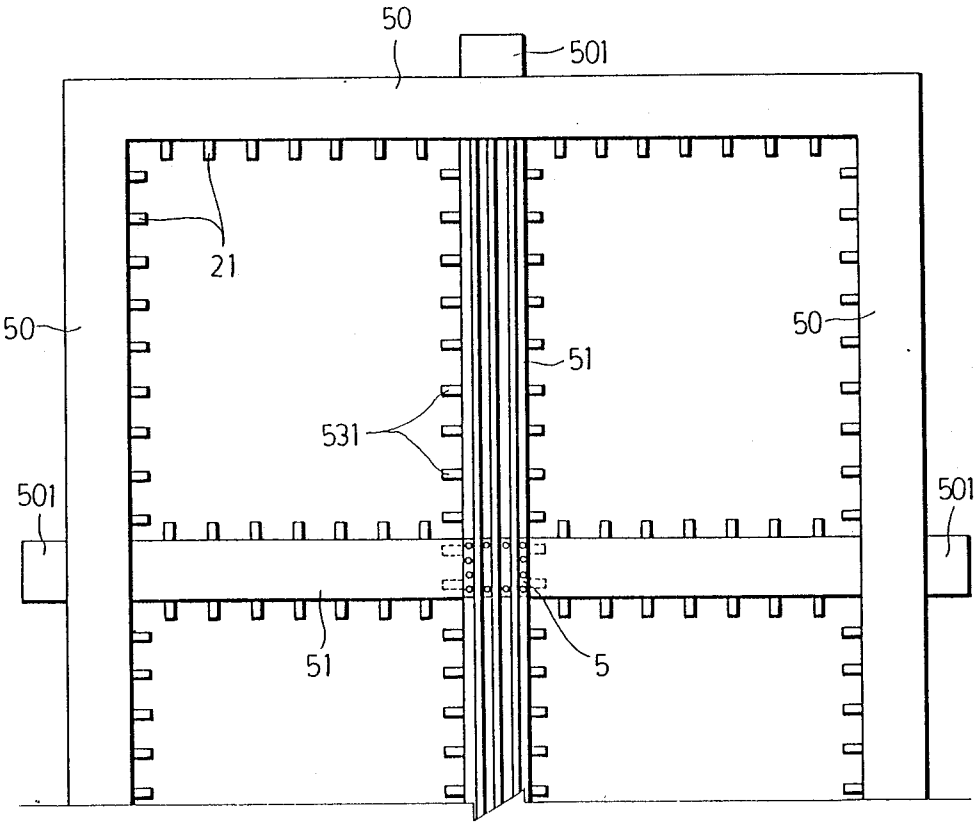
FIG. 5 is a schematic illustration of the steel rods projecting from the reinforcement structures of the side walls and cross beams which join the reinforcements of the upper and lower floors of a basement according to this invention.

Referring to FIGS. 5, 6, 7, 8 and 9, in the construction of a larger basement, the method and means of this invention comprises the steps of: building a plurality of cast-in-place side pillars 501 at a proper distance along the outside of a continuous side wall 50 and a foundation pile 5 in the situs; constructing a plurality of cross beams 51 across the basement to link the foundation pile 5 and support the continuous side wall 50; and removing the earth within the area enclosed by the continuous side wall 50 until all of the projecting steel rods 21 at the lower end of the reinforcement structures 20 are exposed, as shown in FIG. 5, in order to connect the projecting steel rods 21 either by welding or by tie-wire fastening) to the reinforcements of the basement's lower floor so that the continuous side wall and the lower floor of the basement are effectively and solidly connected together after the grouting operation is finished.

Figure 6:
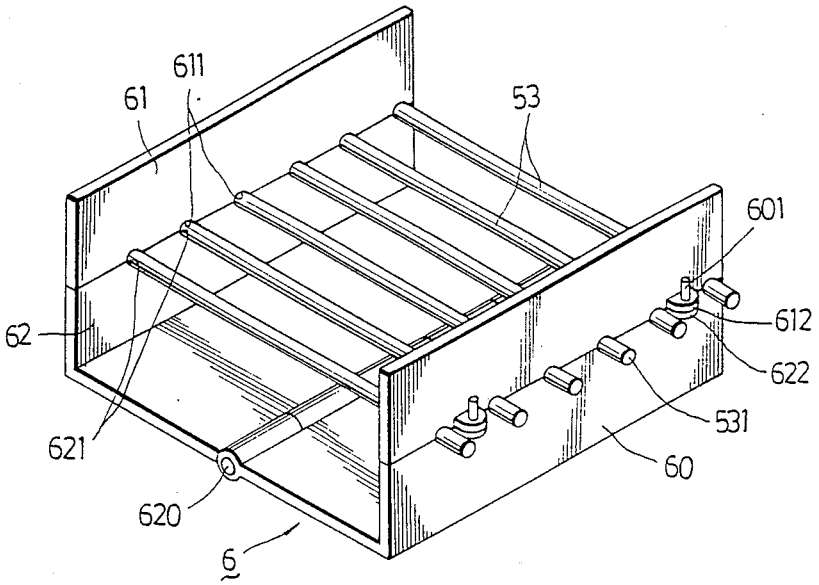
FIG. 6 is a perspective view of a molding means designed to build the cross beams of a basement according to invention.

As shown in FIG. 6, a molding device 6 is provided for building the cross beams 51 according to this invention, wherein the device comprises: a mold casing 60 composed of a separate upper mold case 61 and a lower mold case 62 whose center portion is provided with a pivot joint 620 for being pivotally moved to perform demolding operation therewith; a plurality of semicircular openings 611 and 621 correspondingly formed in the opposing lower ends of the separate upper mold case 61 and the opposing upper ends of the lower mold case 62 to constitute a plurality of joint openings for allowing the reinforcements 53 to pass through and extend from the opposing sides of the mold casing 60; and a plurality of upper and lower coupling rings 612 and 622 correspondingly located at the opposing lower and upper edges of the upper and lower mold cases 61 and 62. After reinforcements 53 are separately layed out in the lower semi-circular openings 621 of the lower mold case 62, by positioning the separate upper mold case 61 over the lower mold case 62 and detachably connecting the coupling rings 612 and 622 through a connecting rod 601, the molding device 6 is ready for grouting operations. When the molding device 6 is taken off after the concrete cross beam 51 becomes dry, the projecting steel rods 531 can be conveniently fastened to the reinforcements of the basement floor, making the entire structure of the basement much stronger than that of the prior art.

Figure 8:
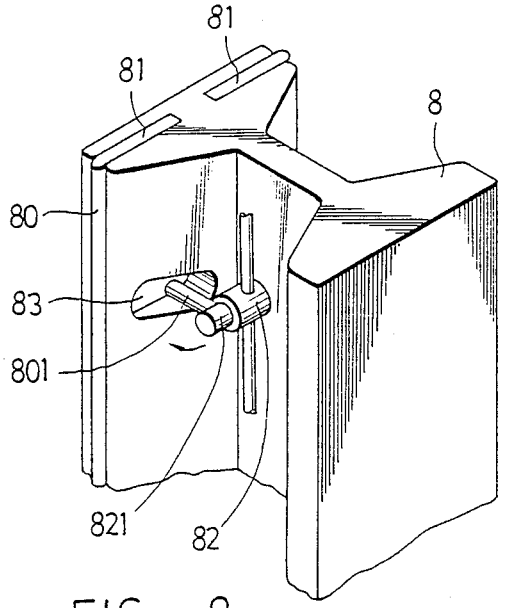
FIG. 8 is a partial perspective view of an H-member designed to seal up each one of the joints shown in FIG. 7.
Figure 7:
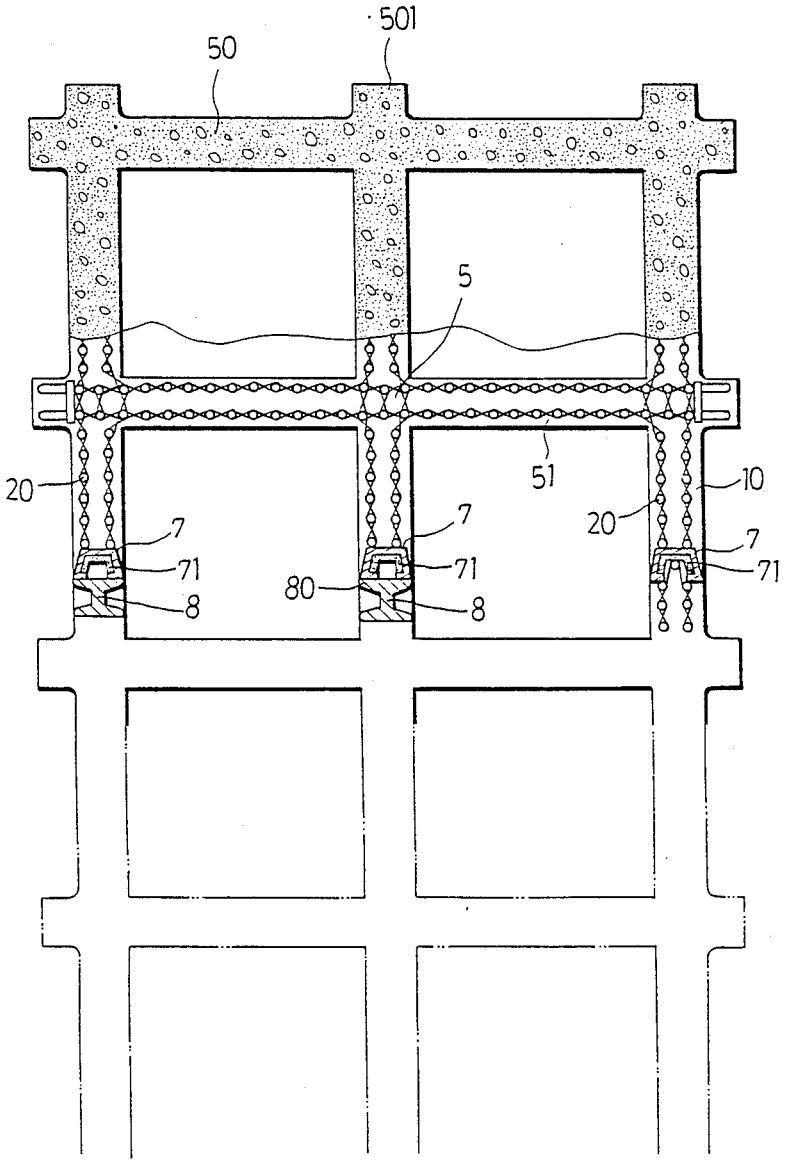
FIG. 7 is an illustration of joints arranged between the side-wall reinforcements of a basement according to invention.

As shown in FIGS. 7 and 8, the continuous side wall 50 is constructed one section after another at the site of a basement, which is especially advantageous in the case of a larger basement. For the purpose of improving the junctions between the vertical side ends of the side wall blocks, a trough means 7 and an H-member 8 are designed to consilidate the junctions of each block of the continuous side wall 50. The method according to this invention comprises the steps of: vertically positioning a trough means 7 at each end of each reinforcement structure 20 with the open section facing outward; lining the inner surface of each buffer means 71 with a buffer member 71 (such as that made of sponge or polystyrene material); and sealing up the open section of each trough means 7 with an H-member 8. Thus, grouting operations can be effectively performed in the side wall trench 10 and sealed up with the H-members 8 without incurring permeation of the grouted cement.

As shown in FIG. 8, the H-member 8 includes a body structure formed in an H shape having a blocking board 80 movably disposed in an open channel 81 provided in one end of the H-member 8, a plurality of hydraulic jacks 82 (the quantity of jacks 82 is determined according to the length of the H-member 8) installed in the dent portion of the H-member 8, and a drive link 801 with one end connected to a jack shaft 821 and the other end fixed on the back side of the blocking board 80 through an elongated opening 83. As can be seen in FIG. 7, the H-member 8 is closely positioned against the open section of trough means 7. By starting the hydraulic jack 82, the blocking board 80 will be driven out by the jack shaft 821 to completely seal the open section of the trough means 7 as well as the side wall trench 10 against the trough means 7 so that during grouting operations, no grouted cement will permeate the open section of the trough means 7 or the closed side wall trench 10.

Before starting the next grouting operation in the remaining side wall trench 10, the blocking board 80 in the H-member 8 is moved back to its original position by the returning movement of the jack shaft 821, while the H-member 8 is removed from the side wall trench 10. The pre-arranged reinforcement structure 20 is placed in the next section of the side wall trench 10 with the front side of the reinforcement structure 20 being inserted into the open section of the original trough means 7 and the back side being flanked with another trough means 7. Then the foregoing operations are repeated for setting the H-members 8 and cement grouting work until the entire continuous side wall 50 of the basement is completed.

Figure 9:
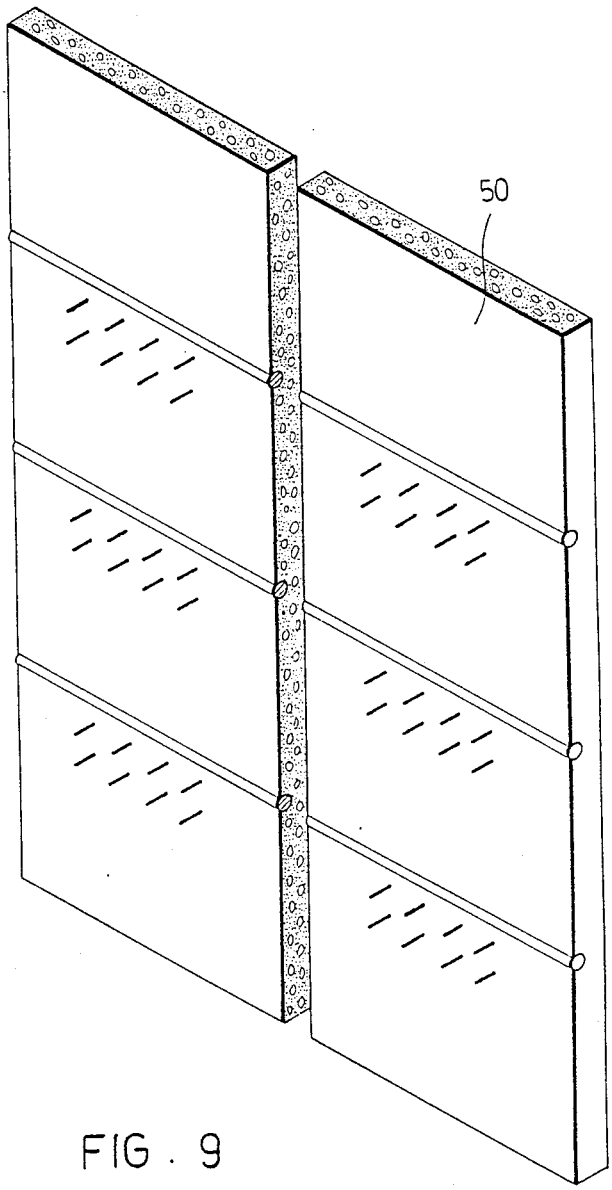
FIG. 9 is a perspective view of a completed continuous side wall of a basement according to this invention.

As shown in FIG. 9, the continuous side wall 50 constructed for a basement according to the method and means of this invention is much stronger and more reliable than that of the prior art. In addition, the buffer means 71 arranged in the trough means 7 between the reinforcement structures 20 can effectively prevent the continuous side wall 50 from cracking due to the expansion and contraction of the reinforcement structures 20 caused by the temperature changes.

The present invention resides in the following features:

(1). Since the work order of the method and means for constructing a basement according to this invention is completely different from the that of the prior art, the construction work of this invention is free from weather constrains and can be done at any time.

(2). By using the trough means 7 and the H-member 8, the continuous side wall 50 for a basement is accomplished one block after another, and the buffer means 71 used between every two blocks of the continuous side wall 50 can effectively serve as a shock absorbing device. Even if the buffer means 71 is eventually damaged by a strong shock, such as a severe earthquake, repairs can be done quickly by applying a vacuum hydraulic pressure operation which uses buffer material (such as polystyrene liquid) to fill the damaged area in the trough means 7 without affecting the structure of the continuous side wall 50.

(3). There is sufficient space in the continuous side wall trench 10 to allow operations to be carried out and to allow the removal of the pushing jacks 32. The width of the side wall trench 10 is about 60 centimeters while the width of the reinforcement structure 20 is about 50 centimeters according to this invention. Therefore, a space at least 10cm wide can allow the pushing jacks 32 to be operated to drive the projecting steel rods 21 into the earth and then be taken out of the side wall trench 10.

(4). Since each of the reinforcement structures 20 is provided with at least two rows of projecting steel rods, as shown in FIG. 9, effective connections can be made with the corresponding steel rods projecting from other arrangements such as that of the foundation piles, floors and other side walls of the basement to increase the strength of the entire basement structure. Moreover, these steel rods are also attached with wooden blocks during construction operation (after the wooden blocks are taken off, the reinforcement structure 20, as shown in FIG. 7, can be clearly seen outside), and after the wooden blocks are taken off, all the steel rods are usually coated with polystyrene material, which can be easily melted for exposing the reinforcement structure 20 and the steel rods.

Having thus described the invention, it is to be understood that many embodiments thereof will suggest themselves without departing from the spirit and scope of the invention. Therefore, it is intended that the specification and drawings be interpreted as illustrative rather than in a limiting sense except as defined in the appended claims.

What is claimed is:

1. A method and means for basement construction comprising the steps of:

(a) excavating a continuous side wall trench according to the construction requirement at a situs of a basement;

(b) preparing a plurality of reinforcement structures, each having a plurality of projecting steel rods horizontally provided in rows at an upper portion and a lower portion on one side thereof;

(c) preparing a plurality of baffle plates each having a plurality of orifices formed in rows therein for being detachably fixed to each one of the reinforcement structures at the lower portion thereof with the projecting steel rods of each reinforcement structure extending out of the orifices of each baffle plate;

(d) detachably installing a plurality of pushing jacks on a back side of each baffle plate, and placing the reinforcement structures, together with the baffle plates and the pushing jacks, in the continuous side wall trench and starting the pushing jacks so as to drive the baffle plate forward to be abutted on the ground with the projecting rods being respectively inserted into the earth of the continuous side wall trench, and then taking out the pushing jacks therefrom;

(e) vertically disposing a plurality of trough devices each having a buffer which lines an inner wall thereof, against a running side of each reinforcement structure with an open section of each trough device facing outward thereat; and (f) vertically positioning an H-member against each open section of the trough devices to closely seal up the continuous side wall trench thereat; so that, by grouting over the reinforcement structures in the closed continuous side wall trench, a strong and shockproof basement side wall will be effectively accomplished.

2. A method according to claim 1 wherein said step (e) further comprises the step of:

disposing a resilient material, such as sponge and polystyrene, on the inner wall of said trough devices to produce a shock absorbing effect thereat.

3. A method according to claim 1 wherein said step (f) comprises the steps of:

building a body structure of said H-member with an open channel and an elongated opening communicating with the open channel formed at one end thereof;

movably disposing a blocking board in the open channel of said body structure; and separately installing a plurality of hydraulic jacks at a dent portion of each body structure of said H-member with a drive link connected between a jack shaft of each hydraulic jack and the blocking board; so that by starting the hydraulic jack to move outward, the blocking board will be moved out to seal up the side wall trench for facilitating the grouting operations without incurring permeation of the grouted cement.

4. A method according to claim 1 further comprises the steps of:

(g) building a plurality of cast-in-place side pillars respectively located along an outer side of the continuous side wall;

(h) constructing a foundation pile in a middle area of the basement ground in conjunction with the continuous side wall; and (i) constructing a plurality of cross beams between every opposing side pillars across the foundation pile through a molding; by removing the earth within the continuous side wall, the projecting steel rods of the reinforcement structures will be completely exposed so that construction work con be effectively performed by connecting the projecting steel rods to a reinforcement structure of a basement floor so as to build a safe and strong basement.

5. A method according to claim 4 wherein said comprises the steps of:

building a separate upper mold case with a plurality of semi-circular openings and upper coupling rings formed at a lower edge thereof; and constructing a lower mold case with a pivot joint provided at a center portion thereof for being pivotally moved to perform a demolding operation and with a plurality of semi-circular openings and lower coupling rings located at an upper edge for accommodating a plurality of steel rods of which each end extends out of the lower mold case; so that by placing the separate upper case over the lower mold case and detachably connecting the upper and lower coupling rings together, grouting operation for the cross beams can be accomplished and a plurality of extending steel rods will be available at each side of each cross beam for being fastened to a reinforcement of a basement floor along with the projecting steel rods of the continuous side wall.

6. An apparatus for basement construction comprising:

a plurality of reinforced structures, each having a plurality of projecting steel rods horizontally provided in rows at an upper portion and a lower portion on one side thereof;

a plurality of baffle plates each having a plurality of orifices formed in rows therein for being detachably fixed to each one of the reinforcement structures at the lower portion thereof with the projecting steel rods of each reinforcement structure extending out of the orifices of each baffle plate;

a plurality of pushing jacks detachably installed on a back side of each baffle plate;

a plurality of trough devices vertically positioned having open sections facing outward from said reinforcement structures;

a buffer which lines an inner wall of each trough device; and an H-member vertically positioned against each open section of each trough device.

7. An apparatus for basement construction according to claim 6 wherein said buffer is a resilient material, such as sponge and polystyrene.

8. An apparatus for basement construction according to claim 6 wherein said H-member further comprises:

a body structure with an open channel;

an elongated opening formed at one end of the body structure for communicating with the open channel;

a blocking board movably disposed in the open channel; and a plurality of hydraulic jacks separately installed at a dent portion of each body structure of said H-member having a drive link connected between a jack shaft of each hydraulic jack and the blocking board.

9. An apparatus according to claim 6 further comprising a plurality of cross beams connecting opposing cast-in-place side pillars across a centrally situated foundation pile through a molding means wherein said molding means comprises:

a separate upper mold case having a plurality of semi-circular openings and upper coupling rings formed at a lower edge thereof;

a lower mold case having a pivot joint provided at a center portion thereof for being pivotally moved to perform a demolding operation, and a plurality of semi-circular openings and lower coupling rings located at an upper edge for accommodating a plurality of steel rods of which each end extends out of the lower mold case; and a connecting rod which detachably connects the upper and lower coupling rings.

* * * * *